US009771731B2

(12) United States Patent
Canavati

(10) Patent No.: US 9,771,731 B2
(45) Date of Patent: Sep. 26, 2017

(54) ARENA HOTEL

(71) Applicant: Jorge L. Canavati, The Woodlands, TX (US)

(72) Inventor: Jorge L. Canavati, The Woodlands, TX (US)

( * ) Notice: Subject to any disclaimer, the term of this patent is extended or adjusted under 35 U.S.C. 154(b) by 0 days.

(21) Appl. No.: 14/977,074

(22) Filed: Dec. 21, 2015

(65) Prior Publication Data

US 2017/0175409 A1 Jun. 22, 2017

(51) Int. Cl.

| | |
|---|---|
| ***E04H 4/00*** | (2006.01) |
| ***E04H 3/02*** | (2006.01) |
| ***E04H 3/12*** | (2006.01) |
| ***E04H 3/22*** | (2006.01) |
| ***E04H 3/14*** | (2006.01) |

(52) U.S. Cl.

CPC ..... *E04H 3/02* (2013.01); *E04H 3/12* (2013.01); *E04H 3/14* (2013.01); *E04H 3/22* (2013.01); *E04H 4/00* (2013.01)

(58) Field of Classification Search

CPC .... E04H 3/02; E04H 3/12; E04H 3/14; E04H 3/22; E04H 4/00

USPC ..... 52/6, 8, 79.4, 245

See application file for complete search history.

(56) References Cited

U.S. PATENT DOCUMENTS 3,263,380 A * 8/1966 Bourbonnais ..... E04H 3/22 52/111
3,313,068 A * 4/1967 Emilio ..... E04H 3/10 352/134
3,399,501 A * 9/1968 Rossman ..... E04H 3/22 52/10
3,466,817 A * 9/1969 Hagel ..... E04H 1/04 52/176
4,686,799 A * 8/1987 Kwake ..... E04H 3/22 52/6
4,726,316 A * 2/1988 Bruns ..... B63B 35/44 114/125
5,103,600 A * 4/1992 Geiger ..... E04H 3/26 52/126.5
5,794,383 A * 8/1998 Labinski ..... E04H 3/12 52/10
5,921,032 A * 7/1999 Labinski ..... E04H 3/12 52/10
6,293,052 B1 * 9/2001 Varnado, Jr. ..... E04H 3/22 52/7
2003/0037490 A1 * 2/2003 Stark, III ..... E04H 3/22 52/6
2007/0000185 A1 * 1/2007 DeLine ..... E04H 3/14 52/33

* cited by examiner

*Primary Examiner* — Paola Agudelo

(74) *Attorney, Agent, or Firm* — James M. Smedley LLC; James Michael Smedley, Esq.

(57) ABSTRACT

The present invention relates to a building construction that includes an internal entertainment venue or event area. Specifically, embodiments of the present invention provide for a building with transient lodging, offices, residential space, or similar living spaces that surround an entertainment venue, event area, or recreational space in manner that allows the entertainment venue, event area, or recreational space to be viewable from those occupied areas of the building.

19 Claims, 8 Drawing Sheets

ARENA HOTEL

FIELD OF THE INVENTION

The present invention relates to a building construction that includes an internal entertainment venue or event area. Specifically, embodiments of the present invention provide for a building with transient lodging, offices, residential space, or similar living spaces that surround an entertainment venue, event area, or recreational space in manner that allows the entertainment venue, event area, or recreational space to be viewable from those occupied areas of the building.

BACKGROUND OF THE INVENTION

Traditionally, buildings and other constructions for event and recreation spaces have been separate from buildings that are used for residential, lodging, or business and other commercial purposes. Additionally, while some hotel properties include banquet halls, auditoriums, and similar event spaces, those event spaces are not viewable from the guest rooms. Overall, current building constructions separate entertainment facilities from lodging or residential spaces.

Therefore, there is a need in the art for a building construction that incorporates entertainment and recreational spaces into a building with a design that allows those entertainment and recreational spaces to be viewable from the lodging, residential, and other occupiable spaces that are in the same building. These and other features and advantages of the present invention will be explained and will become obvious to one skilled in the art through the summary of the invention that follows.

SUMMARY OF THE INVENTION

Accordingly, it is an object of the present invention to provide a building construction that is configured with living spaces or hotel rooms that surround an entertainment venue or event space, such that the entertainment venue or event space is viewable from the occupiable spaces of the building.

According to an embodiment of the present invention, an arena hotel, the hotel comprising: an event space surrounded by a multilevel building with at least a first level and a second level, wherein the first level comprises a viewing concourse that borders the event space and the second level comprises a plurality of hotel rooms that are located across a corridor from one or more limited access seating areas that provide a vantage point of the event space, and one or more attendee seating areas arranged around the event space and configured as a part of the multilevel building, wherein the attendee seating areas are located above the viewing concourse and below the limited access seating areas on the second level.

According to an embodiment of the present invention, the arena hotel further comprises one or more occupiable spaces selected from a group of occupiable spaces comprising of bars, restaurants, patios, ball rooms, spas, gyms, lobbies, and office spaces.

According to an embodiment of the present invention, the one or more limited access seating areas are a plurality of individual private seating boxes.

According to an embodiment of the present invention, the one or more limited access seating areas are a continuous club-level seating area that substantially surrounds the event space.

According to an embodiment of the present invention, the viewing concourse is a continuous corridor around the entirety of the lower level that is configured with a one or more viewing openings looking onto the event space.

According to an embodiment of the present invention, the viewing concourse is configured with one or more doors that provide access to the event space.

According to an embodiment of the present invention, the event space is a multipurpose arena floor.

According to an embodiment of the present invention, an arena hotel, the hotel comprising: an event space surrounded by a multilevel building with at least a first level and a second level, wherein the first level comprises a viewing concourse that borders the event space and the second level comprises a plurality of hotel rooms, a plurality of which are configured with a guest seating area that provides a vantage point of the event space, one or more attendee seating areas arranged around the event space and configured as a part of the multilevel building, wherein the attendee seating areas are located above the viewing concourse and below each of the guest seating areas on the second level, and one or more occupiable spaces selected from a group of occupiable spaces comprising of bars, restaurants, patios, ball rooms, spas, gyms, lobbies, and office spaces.

According to an embodiment of the present invention, the guest seating area is a private seating box that is connected to and accessible via the hotel room.

According to an embodiment of the present invention, the guest seating area is a balcony that is connected to and accessible via the hotel room.

According to an embodiment of the present invention, the one or more of the attendee seating areas are configured as stadium-style seating.

According to an embodiment of the present invention, an arena hotel, the hotel comprising: an event space surrounded by a multilevel building with an outer edge portion, an inner edge portion, and at least a first level and a second level, wherein the first level comprises a viewing concourse that borders the event space and the second level comprises a plurality of hotel rooms that are arranged around the outer edge portion of the multilevel building and a corridor at the inner edge portion of the multilevel building that is used to access the hotel rooms, and one or more attendee seating areas arranged around the event space and configured as a part of the multilevel building, wherein the attendee seating areas are located above the viewing concourse and below the corridor on the second level.

According to an embodiment of the present invention, the wall of the corridor is configured to provide a view of the event space via one or more viewing openings located across the corridor from the hotel rooms.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
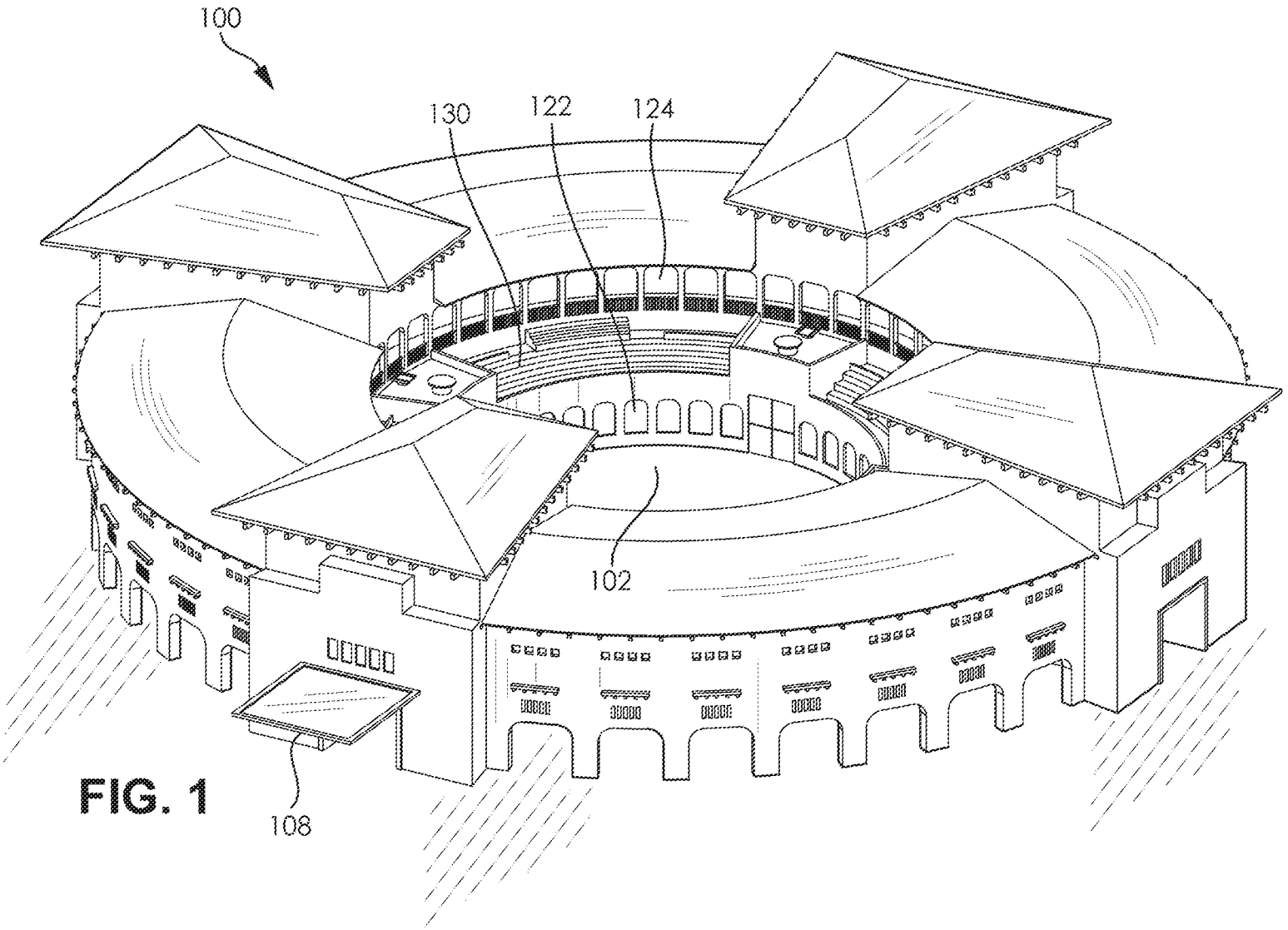
FIG. 1 is a perspective view of building with a central event area surrounded by a seating areas and hotel rooms, in accordance with an embodiment of the present invention.

The present invention relates to a building construction that includes an internal entertainment venue or event area. Specifically, embodiments of the present invention provide for a building with transient lodging, offices, residential space, or similar living spaces that surround an entertainment venue, event area, or recreational space in manner that allows the entertainment venue, event area, or recreational space to be viewable from those occupied areas of the building.

According to an embodiment of the present invention, a construction for a single building that incorporates both entertainment venue or recreation space that is viewable from the living spaces of the building. In a preferred embodiment, the building is configured to feature an entertainment venue or event area that is bordered by a plurality of occupiable spaces that partially or entirely surround the event area. In the preferred embodiment, the occupiable spaces comprise at least a ring or border of hotels rooms around the edge of a multipurpose arena floor or courtyard that is integrated into a portion of the building. In some embodiments, the occupiable spaces may also include, but are not limited to, residential living spaces (e.g. apartments, condos, etc.), entrance lobbies, office spaces, corridors, hallways, seating areas, restaurants, bars, patios, and other common living and work spaces. In the preferred embodiment, the multipurpose arena floor or courtyard is an arena floor, event space, or stage area that is in the center of the occupiable spaces that surround it. One of ordinary skill in the art would appreciate that there are many suitable designs and arrangements for a building featuring an event space surrounded by a hotel room or other occupiable spaces, and embodiments of the present invention are contemplated for use in any such design or arrangement.

According to a preferred embodiment of the present invention, the building is a multi-floor building. In some embodiments, however, the building may be a single floor building. In the preferred embodiment, the occupiable spaces together with the event arena or entertainment area that those spaces surround form the entirety of a building. In an alternate preferred embodiment, the occupiable spaces together with the event arena or entertainment area that those spaces surround may comprise only a portion or segment of a larger overall building construction or complex. One of ordinary skill in the art would appreciate that there are many ways in which the building of the present invention could be configured, and embodiments of the present invention are contemplated for use in any such configuration.

According to an embodiment of the present invention, the building comprises a plurality of occupiable spaces. In a preferred embodiment, the occupiable spaces include at least a series of hotel rooms or similar lodging accommodations that surround the event space or entertainment area. In some embodiments the hotel rooms will be located on the inner or central portion of building, thereby providing direct views of the event space or entertainment area. In such an embodiment, the hotel rooms allow a guest to have a space that essentially functions as both lodging and a private arena box for the event space or entertainment area. In particular, this arrangement allows a guest to experience an event, show, or similar production from the comfort of their hotel room. In some embodiments, the hotel rooms will be located on the outer portion of the building and will not have direct views of the event space or entertainment area. More generally, in any embodiment, the arrangement of the building with a design that incorporates hotel rooms and an entertainment venue in the same space allows for the fusion of what would otherwise be two entirely separate facilities. Specifically, the fusion of the hotel room and entertainment venue in the same space will permit those two areas to function as a single, physically unified concept, as opposed to disjointed or otherwise physically separate spaces.

According to an embodiment of the present invention, the occupiable spaces of the building may be configured as a variety of different spaces instead of or in addition to hotel rooms. In a preferred embodiment, other occupiable spaces that could be incorporated into the building include, but are not limited to, residential living spaces, office space, corridors, hallways, lobbies, and other common living and commercial spaces. In embodiments where the building is at least partially configured as a hotel, the occupiable spaces may include ball rooms, gyms, spa facilities, and service areas commonly associated with hotels (e.g. laundry facilities, bathrooms, utility areas, etc.). As an illustrative example, the building of the present invention could be a mixed-use building with residential, commercial, and retail spaces. In the preferred embodiment, each of those spaces could be configured to provide a view of the entertainment or event space. Views of the event space in any embodiment of the present invention may be enabled via viewing areas, which may include, but are not limited to, windows, balconies, seating areas, or any combination thereof that are incorporated into the occupiable spaces. In other embodiments, however, only certain of the occupiable spaces may include a viewing area or vantage point, while other of the occupiable spaces will not having any viewing area or vantage point. One of ordinary skill in the art would appreciate that the building of the present invention could be designed to incorporate any variety of living, commercial, retail, and other occupiable space, and embodiments of the present invention are contemplated for use with any such space.

According to an embodiment of the present invention, the building of the present invention could be configured with a viewing concourse or viewing promenade that surrounds the event space at one or more levels of the building. The viewing concourse may also be referred to as a viewing corridor, as it could serve as a passageway around the building that also offers views of the event area. In the preferred embodiment, the viewing concourse or promenade will be configured with viewing openings, such as windows, portholes, and similar gaps or openings, which offer vantage points of the event space. In the preferred embodiment, the viewing corridor is a walkway or concourse on the inner portion of the building the offers direct views of the event area through one or more windows or openings that look onto the event area. In some embodiments, the viewing concourse may be configured with one or more doors that provide access to the event space or arena floor. The viewing concourse or viewing corridor could be configured on any level of the building. In a preferred embodiment, the viewing concourse is on the same level as the event space or event floor, which is typically the main level or entrance level of the building. In some embodiments, there may be viewing concourses or viewing corridors on upper levels of the building, particularly in embodiments of the where the hotel rooms on the upper level of the building are configured on the outer portion of the building. One of ordinary skill in the art would appreciate that there are many suitable designs and layouts for a viewing concourse, and embodiments of the present invention are contemplated for use with any such design or layout.

According to an embodiment of the present invention, the building may comprise one or more seating areas from which, hotel guests, building visitors, and event attendees could experience an event or performance. In a preferred embodiment, there may be a variety of different categories of seating areas including, but not limited to, guest seating areas, limited access seating areas, reserved seating areas, attendee seating areas, and general admittance seating areas. In the preferred embodiment, the two primary categories of seating areas may be guest seating areas, which are for hotel guests, and attendee seating areas, which are for event attendees that are not hotel guests. In some embodiments, a given seating areas may be further classified into (i) limited access seating areas, such as club-level seating or private seating boxes, (ii) reserved seating areas with assigned seating, and (iii) general admittance seating areas that are unassigned or "first come, first-served". In the preferred embodiment, the number, type, and arrangement of available seating areas will depend upon the building configuration and the nature of the event taking place in the event space. For example, popular artists and performers would largely require reserved seating areas, while general programing of civic offerings may only require general admittance seating areas. One of ordinary skill in the art would appreciate that seating areas could be classified and organized into a variety of seating area categories, and embodiments of the present invention are contemplated for use with any such seating area category.

According to an embodiment of the present invention, one category of seating area is a guest seating area. In the preferred embodiment, the guest seating areas may be a balcony or private seating box that is a part of the hotel room and reserved for the guests of that room to view the event. In an alternate preferred embodiment, the guest seating areas may be a reserved or private box that is separate from the hotel room. For example, booking a room at the hotel may automatically reserve a private box for the guests of that hotel room. That private box may be across the hallway from the room or in another area of the building. In further preferred embodiments, the guest seating area may be a restricted or limited access seating area or club-level seating area. For example, the limited access seating area may be a club, lounge, or similar seating area with views of the event space. The limited access seating area could be reserved solely for guests of the hotel and for other attendees that have tickets or similar credentials that grant access to the limited access seating area. One of ordinary skill in the art would appreciate there are many suitable designs an layouts for a guest seating area, and embodiments of the present invention are contemplated for use with any such design or layout.

According to an embodiment of the present invention, one category of seating area is an attendee seating area. In the preferred embodiment, the attendee seating areas could be dispersed around the building in any suitable location. For example, the attendee seating areas could be incorporated as a terrace or promenade that is at least partially separate from the other occupiable spaces of the building. In some embodiments, the occupiable spaces and seating areas may be incorporated into different levels of the building to provide separation of the two spaces or to provide a variety of different vantage points of the event space. Examples of seating areas that could be used for attendee seating areas include, but are not limited to, stadium-style seating and bleachers. One of ordinary skill in the art would appreciate there are many suitable designs an layouts for attendee seating areas, and embodiments of the present invention are contemplated for use with any such design or layout.

According to an embodiment of the present invention, access to the seating areas can be regulated or controlled through one or more access controls. In a preferred embodiment, access controls may include, but are not limited to, tickets, assigned seating, or similar means for regulating where guests and attendees have access to for viewing the event. In the preferred embodiment, a primary way to control event access is through the sale of tickets for the event. In some embodiments, a ticket will provide a hotel guest or event attendee with a single specific seat, while in other embodiments the ticket will be for one seat in a larger seating area. In some embodiments, the ticket may simply grant the hotel guest or attendee access to the event itself and there will be no assigned seats or seating areas. In the preferred embodiment, status as a hotel guest may itself function as an access control. As previously described, certain seating areas may be guest seating areas that are seating areas or portions of seating areas that are reserved for guests of the hotel. Those guests seating areas may include, but are not limited to, private boxes the are a part of or otherwise attached to the a hotel room, a private box that is reserved in separate area of the building, or a limited access club-level or lounge with views of the event area. In some embodiments status as a hotel guest may automatically grant free admission to an event, while in other embodiments status as a hotel guest may simply grant a hotel guest a right of first refusal to purchase tickets for certain limited access or reserved seating areas. For example, when booking a room, a guest may be offered the opportunity to purchase tickets or access to an event that is occurring while the guest is staying at the hotel. If a guest declines to purchase access to the guest seating, that guest seating may then be offered as attendee seating. Finally, there may be instances when no access controls are required for the seating areas, such as in a free or open access event. One of ordinary skill in the art would appreciate that there are many ways to implement access controls, and embodiments of the present invention are contemplated for use with any such access control.

According to an embodiment of the present invention, the building may incorporate restaurants, stores, services, and other retail or commercial spaces. In some embodiments, the retail or commercial spaces may include seating, viewing areas, or viewing openings, while in other embodiments those spaces may not include any access or view of an event.

As an illustrative example, the building may include a restaurant that includes window seating, balcony seating, or other table arrangements that provide a view of the event space.

According to an embodiment of the present invention, the building comprises an entertainment space or event area. In a preferred embodiment, the event space may be a stage, event floor, sports field, or similar entertainment area that is integrated into the building and surrounded by the occupiable spaces of the building. In the preferred embodiment, the occupiable spaces and event area share a single, cohesive design or arrangement in which the event space is viewable from at least a portion of the surrounding the occupiable spaces. As an illustrative example, a multipurpose arena floor maybe incorporated as a part of building that has hotel rooms that surround the arena floor. In such an embodiment, the hotel rooms may be arranged on the inner or central portion of the building and include a private arena box that serves as viewing area from which the guests in that room can experience the event taking place in the arena. Alternatively, when the hotel rooms are arranged on the outer portion of the building, there may be viewing concourse or other seating areas that provide views of the event taking place in the arena. On of ordinary skill in the art would appreciate that the building could be configured with any variety of entertainment space or event area, and embodiments of the present invention are contemplated for use with any such entertainment space or event area.

According to an embodiment of the present invention, the various areas of the building may be arranged in any suitable configuration. In a preferred embodiment, the event area or arena floor is surrounded on all sides by either occupiable spaces or seating areas. The event space may be a rounded shape, such a circle or oval, a polygonal shape, such a square, rectangle, or triangle, or any other suitable shape that is required for a given event or performance type. In the preferred embodiment, building is divided into two or more vertical levels, while in other embodiments the building is a single level. In embodiments where the building is multiple levels, the event space or arena floor will typically be located on one of the lowest levels of the building. In the preferred embodiment, occupiable spaces, seating areas, and other portions of the building will be around and above the event space in order to provide ideal vantage points for viewing the performance and events taking place on the event floor. In the preferred embodiment, the building may be largely the same shape as the event space. For example, if the event area is circular, then the building may also be circular. In an alternate preferred embodiment, the building may be a different shape than the event space. For example, if the event area is circular, then the building may be square or rectangular. One of ordinary skill in the art would appreciate that there are many suitable arrangements for the levels and layouts of the building, and embodiments of the present invention are contemplated for use with any such arrangement or layout According to an embodiment of the present invention, the building is a multilevel or multi-floor building. In preferred embodiment, the lowest level or bottom floor of the building is the main floor, which includes an entrance lobby. In some embodiments, the lower level or bottom floor of the building may also include a restaurant, a ball room, spa and gym areas, one or more viewing corridors, and office or business spaces. In the preferred embodiment, the upper levels of the building are primarily configured with hotel rooms, hallways, and seating areas, but may also include any other of the previously mentioned occupiable spaces including, but not limited to viewing concourses and service areas. One of ordinary skill in the art would appreciate that there are many suitable floorplan layouts for the various levels or floors of the building, and embodiments of the present invention are contemplated for use with any such floorplan layout.

According to an embodiment of the present invention, the building is configured with a plurality of hotel rooms on one or more levels of the building. In a preferred embodiment the hotels rooms are primarily located on the upper levels of the building. In the preferred embodiment, a guest will access the hotel room via one or more hallways, corridors, or passageways that run through the building. In some embodiments, because the building surrounds the event space, the hallways or corridors may be continuous and go around the entire floor or level of the building. The hotel rooms may be arranged either on the outer portion of the building, without a direct view of the arena floor, or on the inner portion of the building with a direct view of the arena floor. In some embodiments, hotel rooms may be located across the hallway or corridor from a seating area. In some embodiments the hallway or corridor that provides access to the hotel rooms may also function as a viewing concourse or viewing corridor. One of ordinary skill in the art would appreciate that there are variety of suitable layouts and locations for a hotel room, and embodiments of the present invention are contemplated for use with any such layout or location.

According to an embodiment of the present invention, the hotel rooms may be arranged on the outer portion of the building, without direct views of the events space or arena floor. In the preferred embodiment, the inner portions of the building will therefore include the hallways or corridors that are used to access the hotel rooms. In some embodiments, the hallways or corridors will also be configured as a viewing concourse or viewing corridor that provides views of the event space or arena floor. Alternatively, there will be seating areas configured across the hallway from the hotel rooms. Those seating areas would not be directly attached to or otherwise continuous with the hotel room and instead be accessed from the hallway or corridor running between the hotel room and the seating area. In the preferred embodiment, those seating areas may be limited access seating areas such private boxes or club-level areas that are configured on the innermost portion of the building and have views of the arena floor. The seating areas in this embodiment would not be directly attached to or continuous with the hotel rooms. The detached private boxes may be reserved for guests of a particular hotel room. Alternatively, the detached private boxes may be for any event attendee or hotel guest that has purchased a ticket or access to that box. The club-level seating area may be a seating area or lounge that is surrounds and has views of the event space or arena floor. Similar to the private boxes, the club-level may be reserved for hotel guests or any event attendee or hotel guest that has purchased a ticket or access to the club-level area. The primary difference between the private box and the club-level seating is that the private box is a smaller, private area with a limited amount of space or seating, whereas the club-level seating area is larger, substantially undivided, and continuous space that surrounds a substantial portion of the event space on the floor of the building that the club-level is located on.

According to an embodiment of the present invention, the hotel rooms may be arranged on the innermost portion of the building, with direct views of the event space or arena floor. In a preferred embodiment, the outer portions of the building will therefore include the hallways or corridors that are used to access the hotel rooms. In the preferred embodiment, the hotel rooms are configured with windows or a private box or balcony that is attached directly to or otherwise continuous with the hotel room. The windows, private box, or balcony serves as a viewing area for guests of that hotel room. Therefore, the hotel guests would not have to leave their hotel room to enjoy the performance that is occurring in the event space or on the arena floor.

EXEMPLARY EMBODIMENTS

According to a preferred embodiment of the present invention, the building is configured as a hotel with rooms and seating areas that face a multipurpose arena integrated as a courtyard, event floor, or event area in the center of the hotel. In the preferred embodiment, one or more limited access seating areas will be configured across the hallway from the hotel rooms on the upper levels of the hotel. These limited access seating areas include, but are not limited to, private boxes and club-level seating areas. In some embodiments, these limited access seating areas may be reserved exclusively for hotel guests, while in other embodiments these limited access seating areas may be available to any event attendee as a separate ticket, but in some cases only after being offered to hotel guests that have a right of first refusal to purchase the ticket for those limited access seating areas. In an alternate preferred embodiment, any or all of the hotel rooms may be configured to face the arena courtyard or event area. The hotel rooms will have views of the event area via windows, balconies, or private seating boxes that are attached to the room. In the preferred embodiment, the hotel arena fusion allows guests to experience an event or other entertainment without leaving their room. The configuration of the building in the present invention provides a single building where there is not only a hotel and entertainment venue together, but rather both elements functioning together as a single space concept. One of ordinary skill in the art would appreciate that the building could be designed in a myriad of configurations and layouts, all of which could incorporate the unified hotel and event area concept and without departing from the spirit and scope of the present invention.

Turning now to FIG. 1, an exemplary embodiment of an arena hotel in accordance with an embodiment of the present invention. In a preferred embodiment, the arena hotel 100 is a multi-floor building with one or more hotel rooms (not shown) surrounding a multipurpose arena floor 102. In the preferred embodiment, each of the hotel rooms includes a private box or balcony 124 that provides a view of the multipurpose arena floor 102. The arena hotel also comprises one or more attendee seating areas 130 that also provide a view of the multipurpose arena floor 102.

Figure 2:
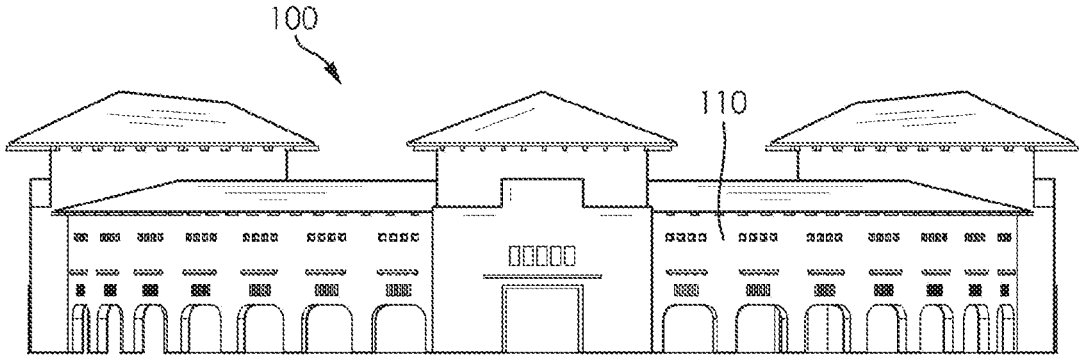
FIG. 2 is a side view of building with a central event area surrounded by a seating areas and hotel rooms, in accordance with an embodiment of the present invention.
Figure 3:
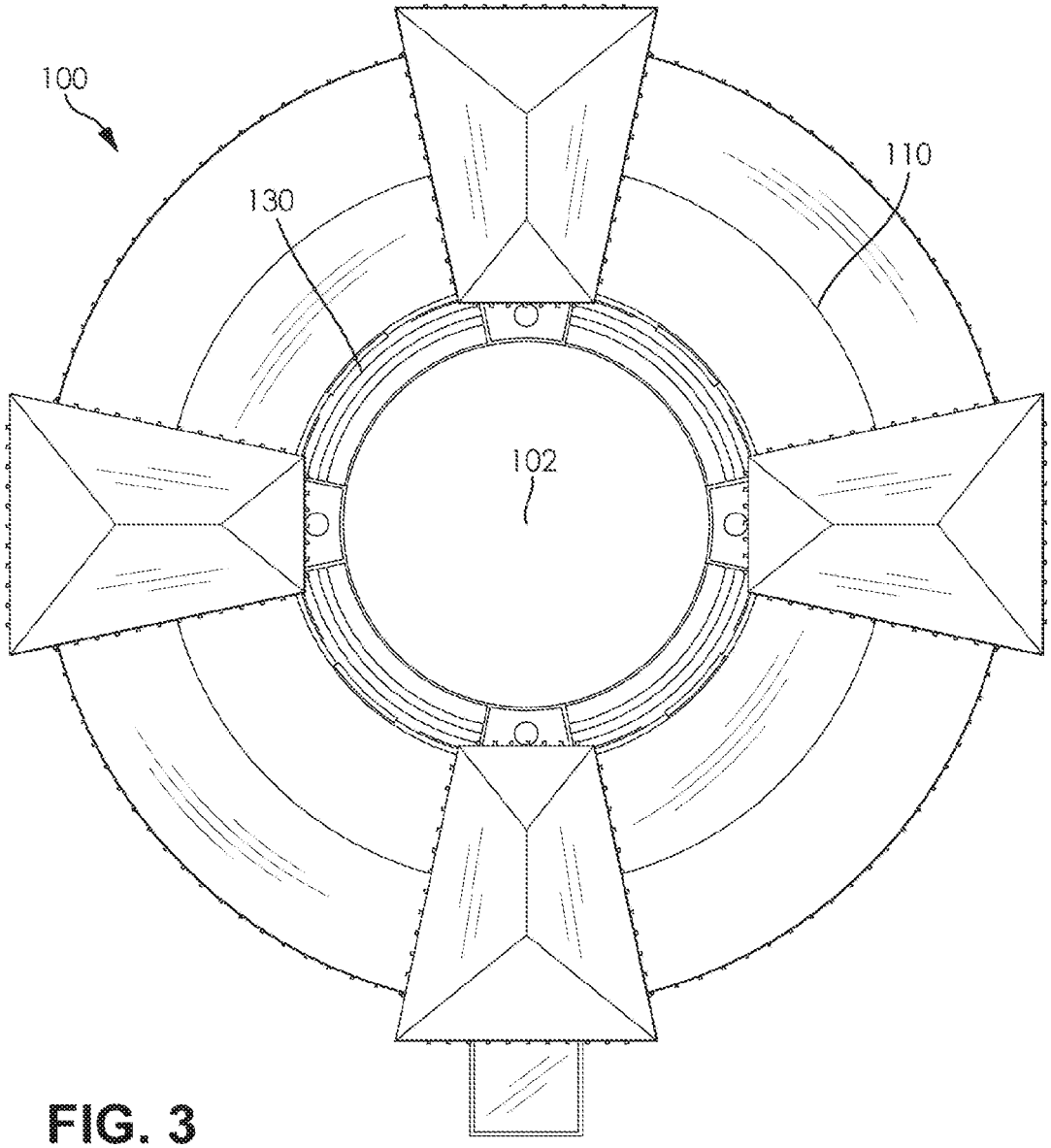
FIG. 3 is a top view of building with a central event area surrounded by a seating areas and hotel rooms, in accordance with an embodiment of the present invention.
Figure 4:
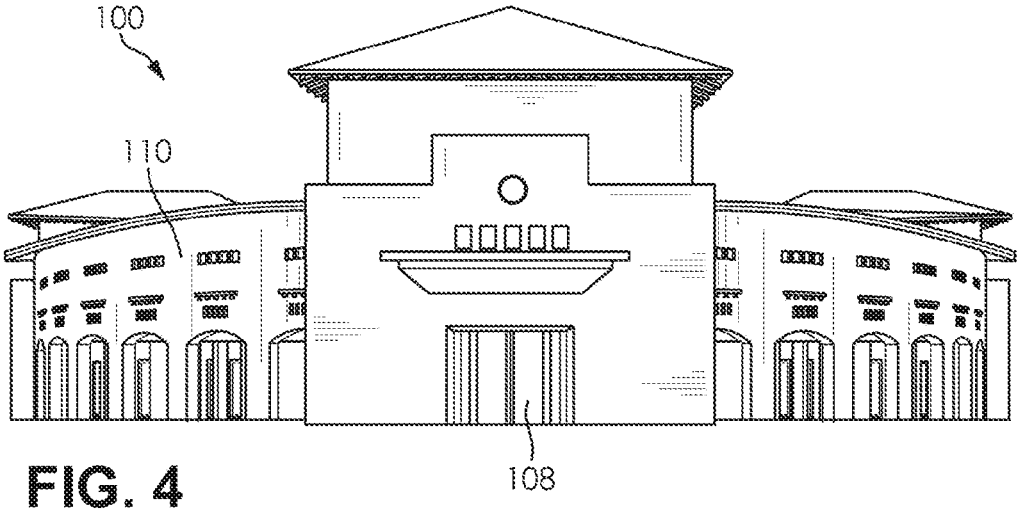
FIG. 4 is a front view of building with a central event area surrounded by a seating areas and hotel rooms, in accordance with an embodiment of the present invention.

FIGS. 2-4 illustrate various outside views of an arena hotel in accordance with an embodiment of the present invention. In a preferred embodiment, the arena hotel 100 is primarily comprised of various occupiable spaces 110 surrounding a central located multipurpose arena floor 102. As shown in FIG. 4, the arena hotel 100 features a main entrance area 108 that provides access to the occupiable areas 110 inside of the arena hotel 100. In the preferred embodiment, the occupiable spaces 110 may include hotel rooms, restaurants, lobbies, and various service areas. As shown in FIG. 3, the arena hotel 100 also includes seating areas 103 surrounding the multipurpose arena floor 102.

Figure 5:
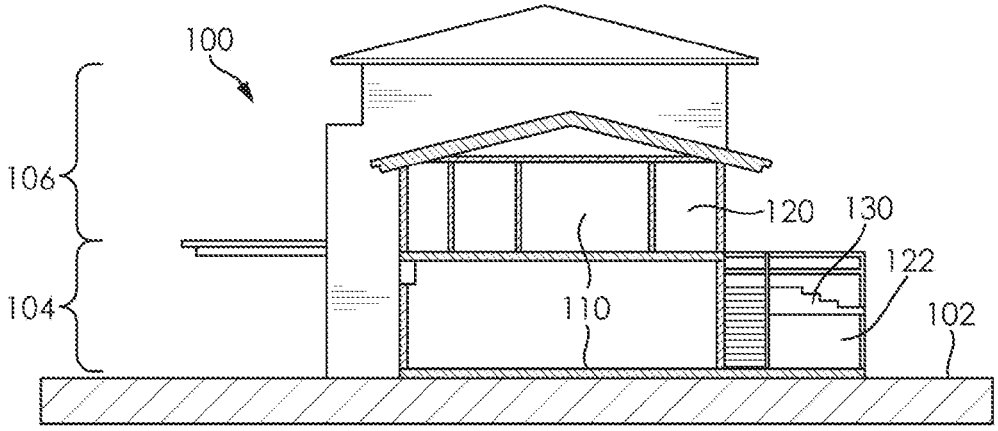
FIG. 5 is a side cross-section of building with a central event area surrounded by a seating areas and hotel rooms, in accordance with an embodiment of the present invention.
Figure 6:
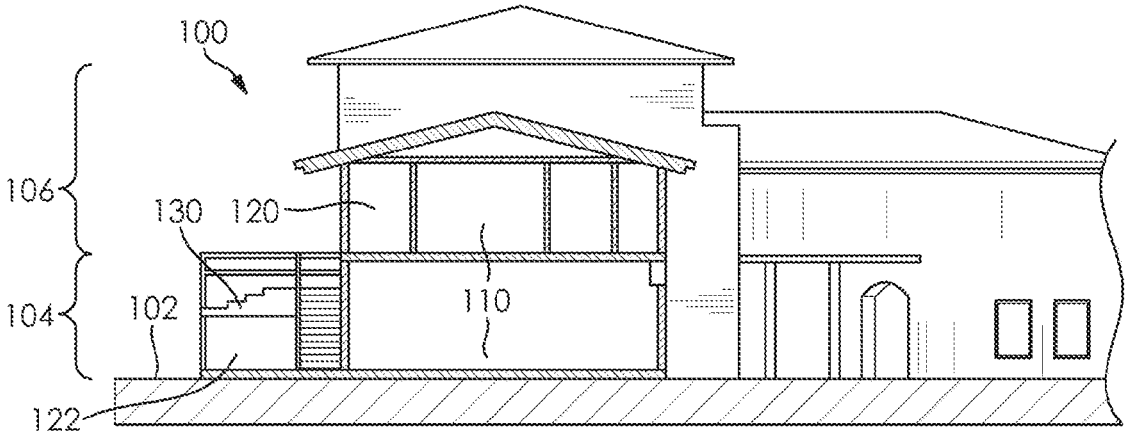
FIG. 6 is an alternate side cross-section of building with a central event area surrounded by a seating areas and hotel rooms, in accordance with an embodiment of the present invention.

Turning now to FIGS. 5 and 6 show side cross-sections of an arena hotel in accordance with an embodiment of the present invention. In a preferred embodiment, the arena hotel 100 is primarily comprised of at least two levels, a lower level 104 and an upper level 106, each of which are configured with various occupiable areas 110. In the preferred embodiment, the lower level may be configured with occupiable spaces that include, but are not limited to, restaurants, entrance lobbies, hotel rooms, and ball rooms, while the upper levels will be primarily configured with hotel rooms. The preferred embodiment of the arena hotel 100 will also feature one or more attendee seating areas 130 that have a view or vantage point of the multipurpose arena floor 102. Other areas of the arena hotel 100 that are configured to provide a view of multipurpose arena floor 102 are the limited access seating areas 120 that are a part of the upper level 106 hotel rooms (not shown) and the corridors around the multipurpose arena floor 102. In the preferred embodiment, some of the corridors may be configured as viewing concourses 122 that have offer numerous vantage points of the multipurpose arena floor 102.

Figure 7:
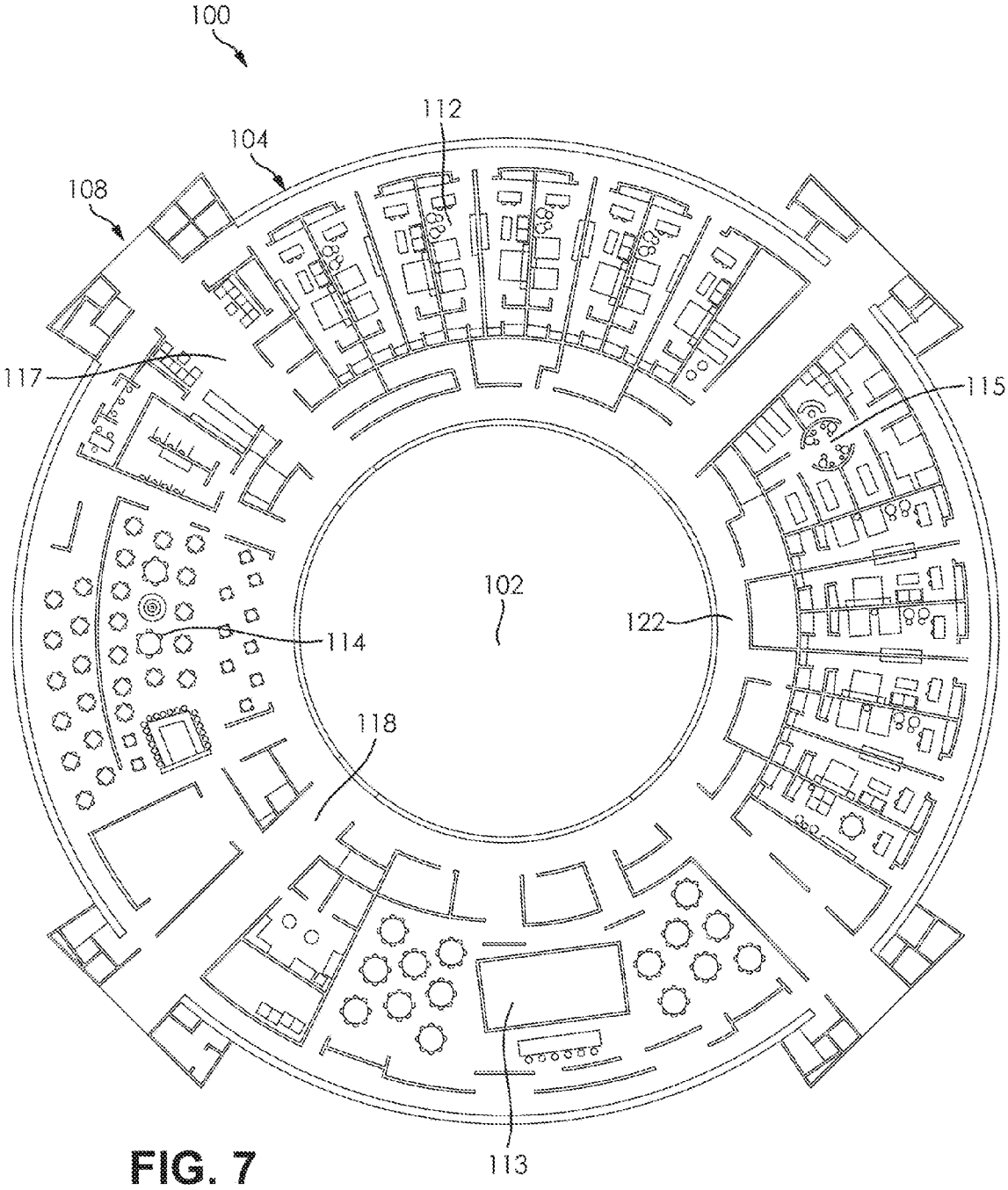
FIG. 7 is an exemplary floor plan of a lower level of a building with a central event area surrounded by a seating areas and hotel rooms, in accordance with an embodiment of the present invention.

FIG. 7 shows an overhead cross-section view of a lower level of an arena hotel in accordance with an embodiment of the present invention. In a preferred embodiment, the lower level 104 of an arena hotel 100 has adaptable layout with occupiable spaces that can be diversified for a number of uses. In the preferred embodiment, the arena hotel 100 includes a main entrance 108 that open into an entrance lobby 117 from which a person can access the other portions of the arena hotel 100. Additionally, the lower level 104 of the arena hotel 100 may include occupiable spaces such as hotel rooms 112, ball rooms 113, restaurants 114, spas 115, and corridors 118. In a preferred embodiment, at least one corridor 118 will be configured as a viewing concourse 122.

Figure 8:
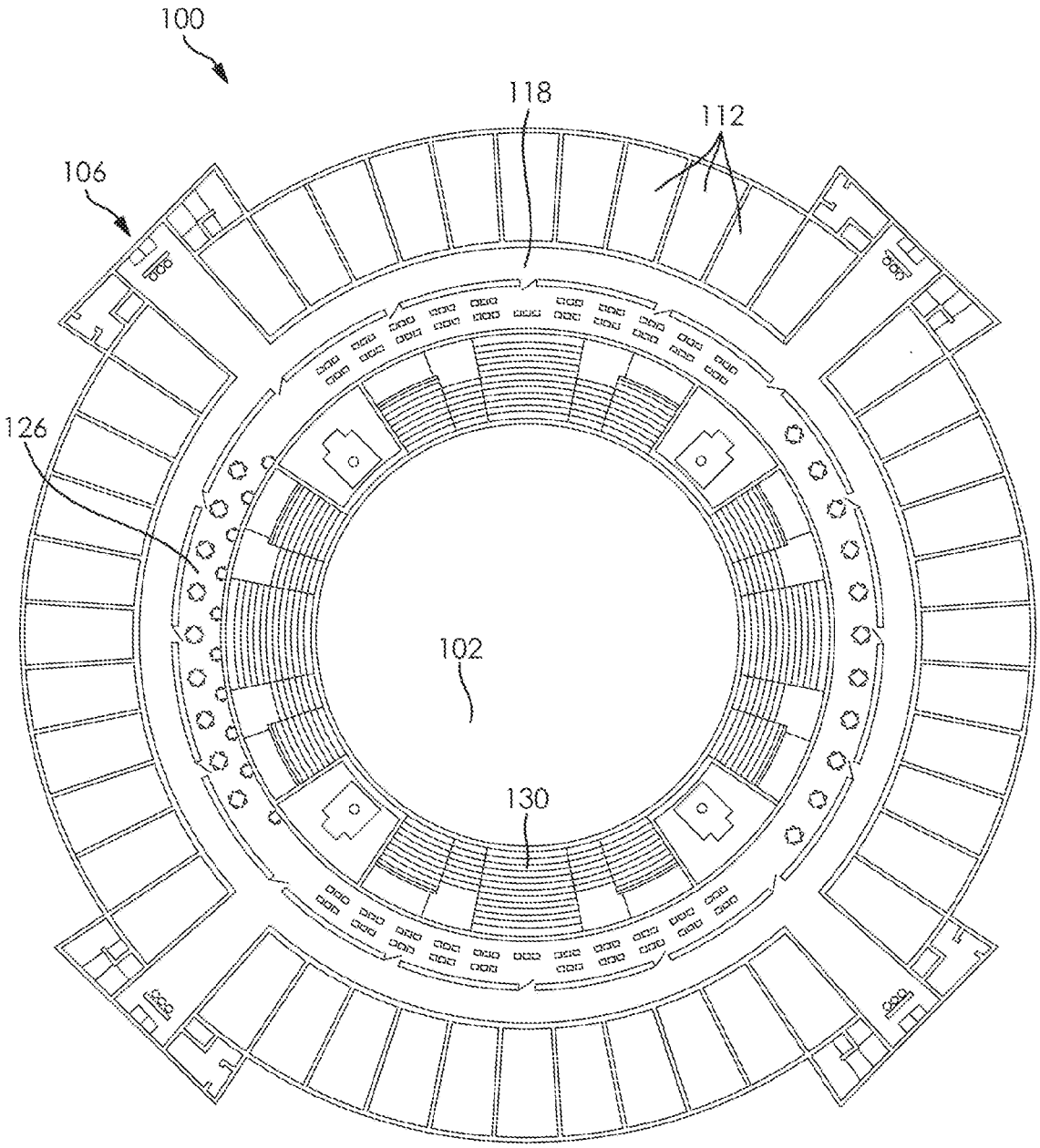
FIGS. 8-11 are exemplary floor plan layouts of an upper level of a building with a central event area surrounded by a seating areas and hotel rooms, in accordance with an embodiment of the present invention.

FIG. 8 shows an exemplary floor plan layout of an upper level of an arena hotel in accordance with an embodiment of the present invention. In a preferred embodiment, the upper level 106 of an arena hotel 100 is primarily configured with hotel rooms 112 around the outer portion of the building and a limited access seating area, such as a club-level or lounge 126, on the inner portion of the building. In the preferred embodiment, the hotel rooms 112 and club-level 126 are separated by and accessed via a corridor 118. Additionally, the attendee seating areas 130 are sufficiently raised above the lower level of the arena hotel 100 so as to allow the multipurpose arena floor 102 to be viewable from the viewing concourse on the lower level.

Figure 9:
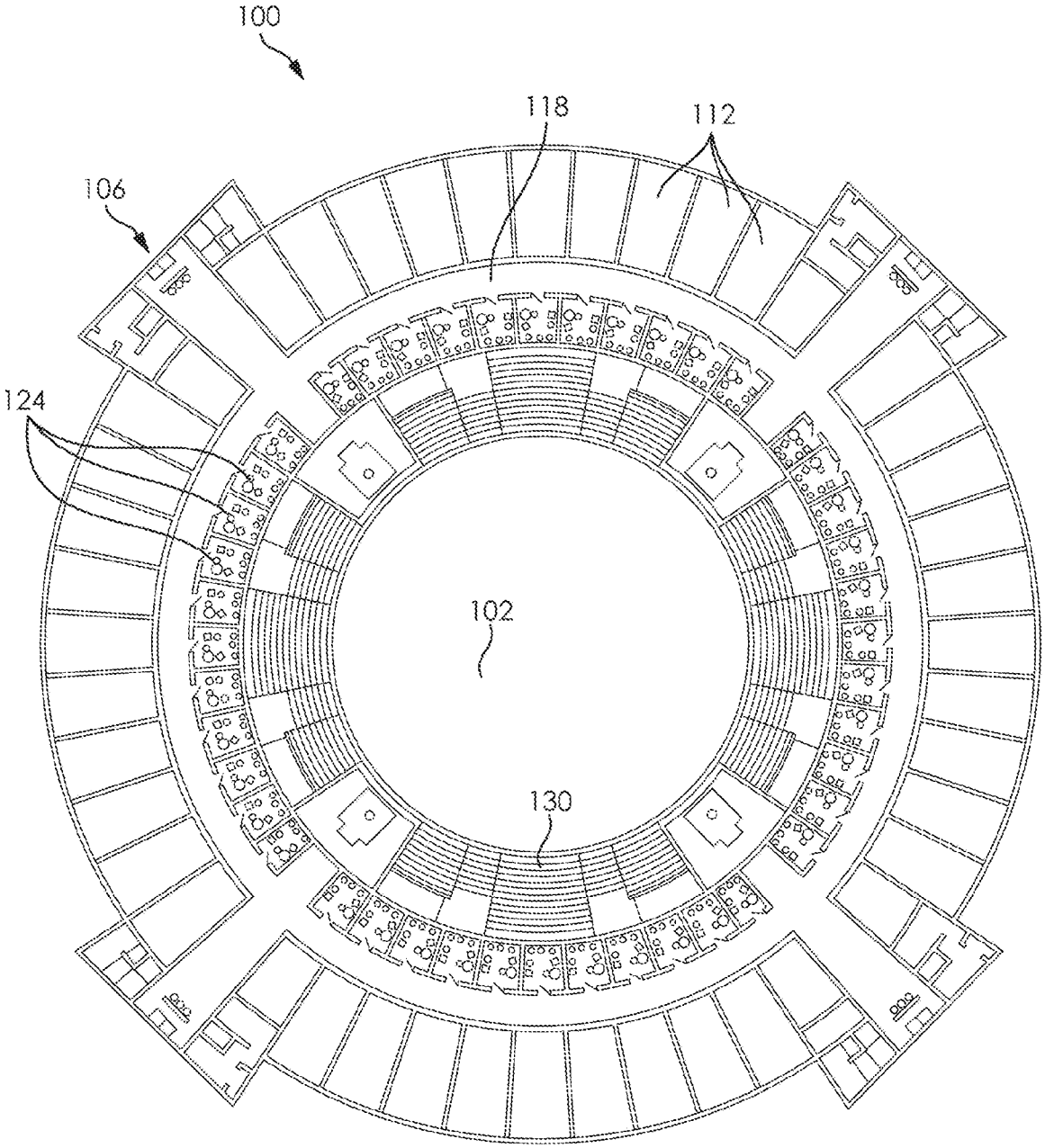

FIG. 9 shows an exemplary floor plan layout of an upper level of an arena hotel in accordance with an embodiment of the present invention. In a preferred embodiment, the upper level 106 of an arena hotel 100 is primarily configured with hotel rooms 112 around the outer portion of the building and a plurality of limited access seating areas, such as private boxes 124, on the inner portion of the building. The limited access seating area provides a vantage point of the event space 102. In the preferred embodiment, the hotel rooms 112 and private boxes 124 are separated by and accessed via a corridor 118. Additionally, the attendee seating areas 130 are sufficiently raised above the lower level of the arena hotel 100 so as to allow the multipurpose arena floor 102 to be viewable from the viewing concourse on the lower level.

Figure 10:
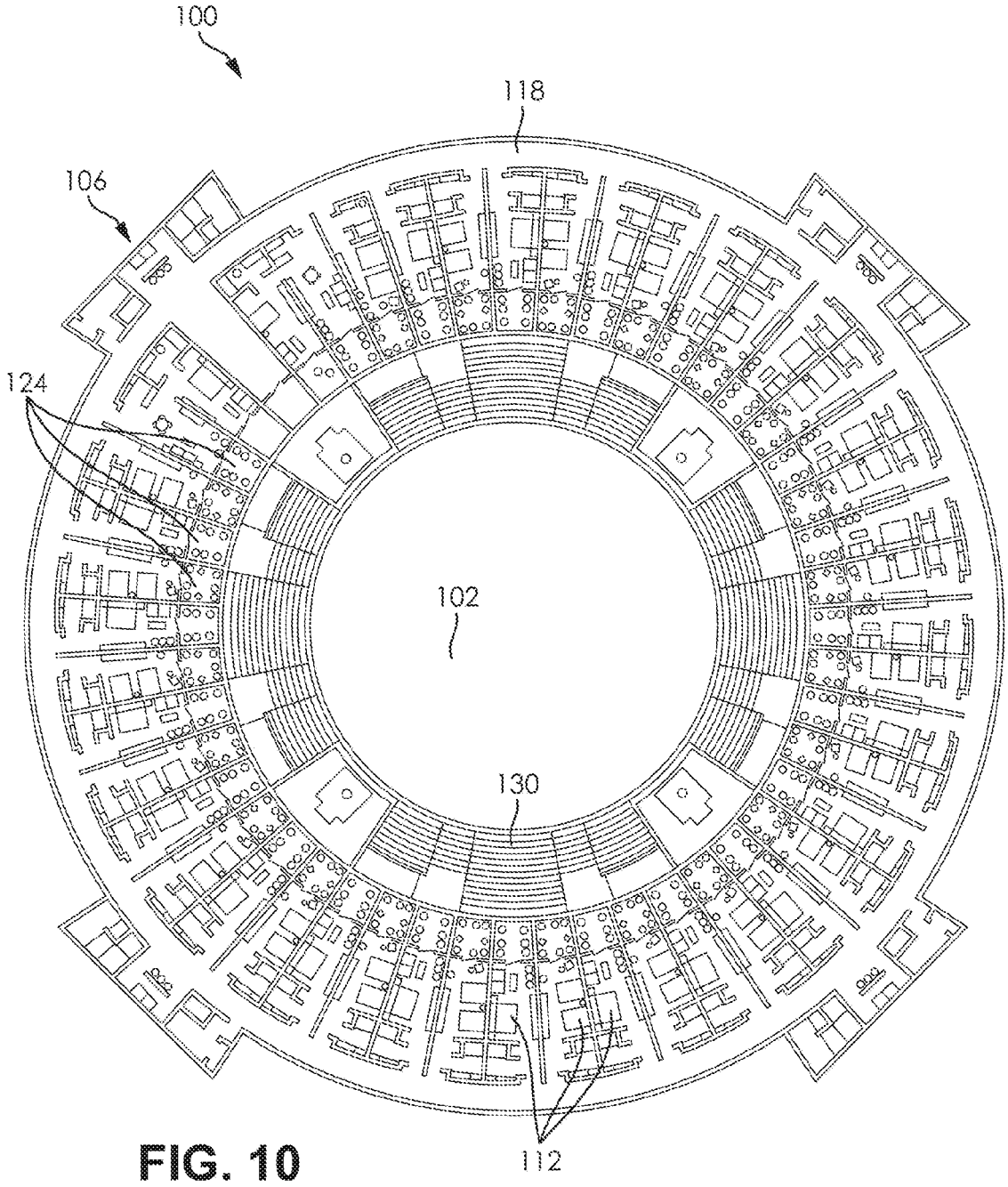

FIG. 10 shows an exemplary floor plan layout of an upper level of an arena hotel in accordance with an embodiment of the present invention. In a preferred embodiment, the upper level 106 of an arena hotel 100 is primarily configured with hotel rooms 112 around the inner portion of the building, with a corridor 118 for accessing the hotel rooms 112 around the outer portion of the building. In the preferred embodiment, each of the hotel rooms 112 includes a private box 124 that is attached to the hotel room 112 and provides a vantage point of the multipurpose arena floor 102. The private box 124 may be a private seating box or balcony that is only accessible through the hotel room 112, thereby creating a private viewing area for the guest staying in that room. Additionally, the attendee seating areas 130 are sufficiently raised above the lower level of the arena hotel 100 so as to allow the multipurpose arena floor 102 to be viewable from the viewing concourse on the lower level.

Figure 11:
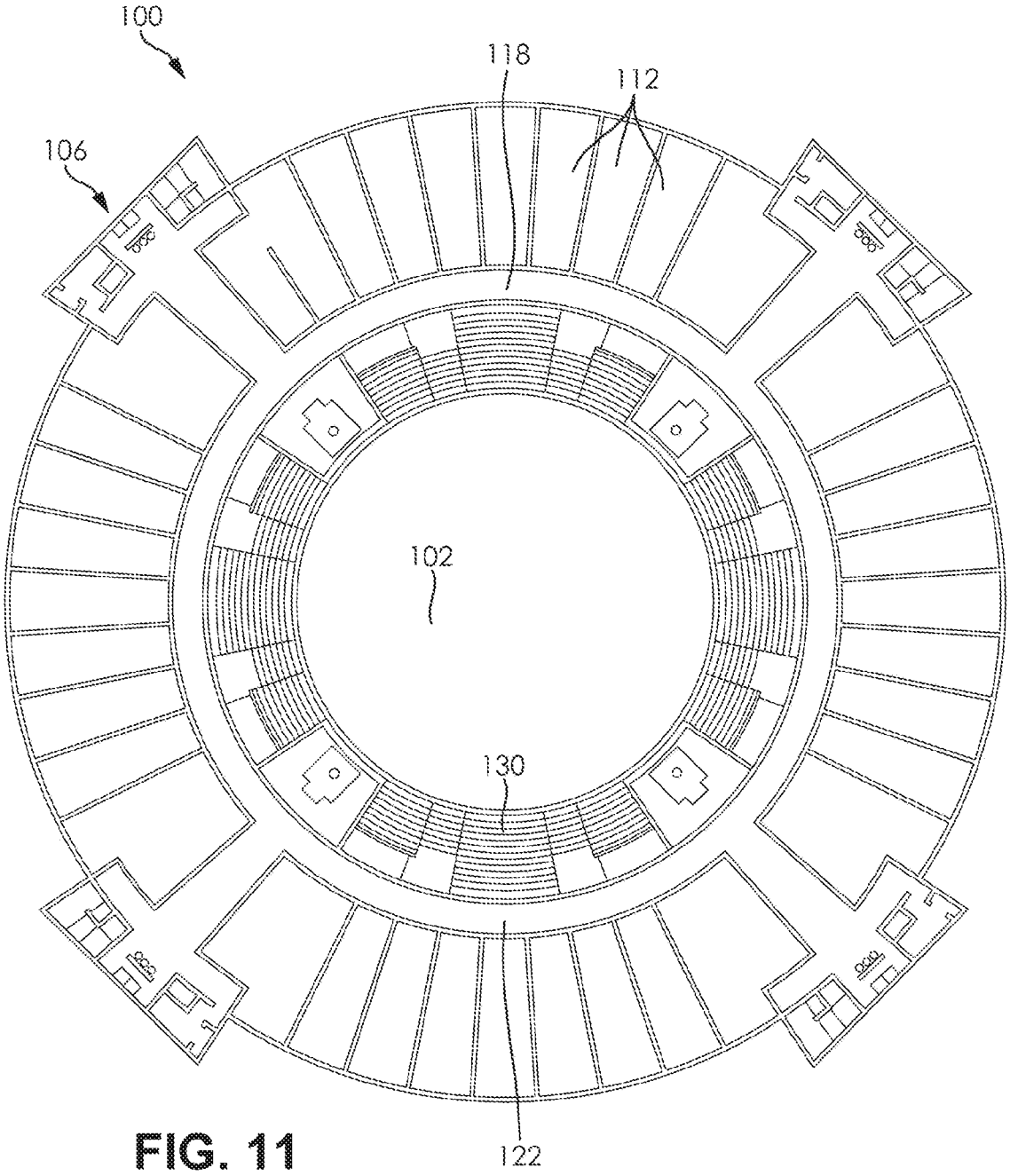

FIG. 11 shows an exemplary floor plan layout of an upper level of an arena hotel in accordance with an embodiment of the present invention. In a preferred embodiment, the upper level 106 of an arena hotel 100 is primarily configured with hotel rooms 112 around the outer portion of the building and a corridor 118 around the inner portion of the building. In the preferred embodiment, the corridor 118 may also be configured as a viewing concourse 122 that offers views of the event space 130. Additionally, the attendee seating areas 130 are sufficiently raised above the lower level of the arena hotel 100 so as to allow the multipurpose arena floor 102 to be viewable from the viewing concourse on the lower level.

As shown in FIGS. 1, 5, and 6, in the preferred embodiment of the arena hotel 100, the attendee seating areas 130 are lower than both the limited access seating areas 120 and the private boxes 124 of the hotel rooms that are on the upper level 106 of the arena hotel 100, but raised above base of the lower level 104 of the arena hotel 100 so that the event space 102 remains viewable from a viewing concourse 122 on the lower level 104 of the arena hotel 100.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An arena hotel, said hotel comprising:
- an event space surrounded by a multilevel building with at least a first level and a second level,
- wherein said first level comprises a viewing corridor having an inner wall that abuts and defines a border of said event space,
- wherein said second level comprises,
- a plurality of hotel rooms that are at an outer edge of said arena hotel,
- one or more limited access seating areas that provide a vantage point of said event space at an inner edge of said arena hotel, and
- a continuous corridor that physically separates and provides access to each of said plurality of hotel rooms and said one or more limited access seating areas; and
- one or more attendee seating areas arranged around said event space and configured as a part of said multilevel building, wherein said attendee seating areas are positioned directly on top of said viewing corridor and below said limited access seating areas on said second level.

2. The arena hotel of claim 1, further comprising one or more occupiable spaces selected from a group of occupiable spaces consisting of bars, restaurants, patios, ball rooms, spas, gyms, lobbies, and office spaces.

3. The arena hotel of claim 1, wherein said one or more limited access seating areas are a plurality of individual private seating boxes.

4. The arena hotel of claim 1, wherein said one or more limited access seating areas are a continuous club-level seating area that substantially surrounds said event space.

5. The arena hotel of claim 1, wherein said viewing corridor is a continuous, substantially enclosed corridor around the entirety of said lower level that is configured with a one or more viewing openings looking onto said event space.

6. The arena hotel of claim 1, wherein said viewing corridor is configured with one or more doors that provide access to said event space.

7. The building of claim 1, wherein said event space is a multipurpose arena floor.

8. An arena hotel, said hotel comprising:
- an event space surrounded by a multilevel building with at least a first level and a second level,
- wherein said first level comprises a viewing corridor having an inner wall that abuts and defines a border of said event space,
- wherein said second level comprises a plurality of hotel rooms, a plurality of which are configured with a guest seating area that provides a vantage point of said event space;
- one or more attendee seating areas arranged around said event space and configured as a part of said multilevel building,
- a continuous corridor that physically separates and provides access to each of said plurality of hotel rooms,
- wherein said attendee seating areas are positioned directly on top of said viewing corridor and below each of said guest seating areas on said second level; and
- one or more occupiable spaces selected from a group of occupiable spaces comprising of bars, restaurants, patios, ball rooms, spas, gyms, lobbies, and office spaces.

9. The arena hotel of claim 8, wherein said viewing corridor is a continuous, substantially enclosed corridor around the entirety of said lower level that is configured with a one or more viewing openings looking onto said event space.

10. The arena hotel of claim 8, wherein said viewing corridor is configured with one or more doors that provide access to said event space.

11. The arena hotel of claim 8, wherein said guest seating area is a private seating box that is connected to and accessible via said hotel room.

12. The arena hotel of claim 8, wherein said guest seating area is a balcony that is connected to and accessible via said hotel room.

13. The arena hotel of claim 8, wherein one or more of said attendee seating areas are configured as stadium-style seating.

14. An arena hotel, said hotel comprising:
- an event space surrounded by a multilevel building with an outer edge portion, an inner edge portion, and at least a first level and a second level,
  - wherein said first level comprises a viewing corridor having an inner wall that abuts and defines a border of said event space,
  - wherein said second level comprises,
    - a plurality of hotel rooms that are arranged around said outer edge portion of said multilevel building, and
    - a continuous corridor at said inner edge portion of said multilevel building that provides direct access to said hotel rooms; and
- one or more attendee seating areas arranged around said event space and configured as a part of said multilevel building, wherein said attendee seating areas are positioned directly on top of said viewing corridor and below said corridor on said second level.

15. The building of claim 14, further comprising one or more occupiable spaces selected from a group of occupiable spaces consisting of bars, restaurants, patios, ball rooms, spas, gyms, lobbies, and office spaces.

16. The building of claim 14, wherein said viewing corridor is a continuous, substantially enclosed corridor around the entirety of said lower level that is configured with a one or more viewing openings looking onto said event space.

17. The building of claim 14, wherein an inner wall of said corridor is configured to provide a view of said event space via one or more viewing openings located across said corridor from said hotel rooms.

18. The building of claim 14, wherein one or more of said attendee seating areas are configured as stadium-style seating.

19. The building of claim 14, wherein said event space is a multipurpose arena floor.

* * * * *